United States Patent [19]

Latimer

[11] 4,208,813

[45] Jun. 24, 1980

[54] STEERABLE OCEAN FLOOR DREDGE VEHICLE

[75] Inventor: John P. Latimer, Newport News, Va.

[73] Assignee: Deepsea Ventures, Inc., Gloucester Point, Va.

[21] Appl. No.: 910,080

[22] Filed: May 26, 1978

[51] Int. Cl.[2] ..... E02F 7/00; E02F 3/88

[52] U.S. Cl. ..... 37/58; 37/72; 37/DIG. 8; 114/246

[58] Field of Search ..... 37/54, 58, 57, DIG. 8, 37/72; 299/8, 9; 280/442, 419, 16, 21 R, 97, DIG. 9, DIG. 14; 114/244, 245, 246

[56] References Cited

U.S. PATENT DOCUMENTS

| | | | |
|---|---|---|---|
| 323,639 | 8/1885 | Cowden | 114/246 |
| 398,631 | 2/1889 | Lassoe | 114/246 |
| 493,113 | 3/1893 | Peterson | 115/246 |
| 3,588,174 | 6/1971 | Rossfelder et al. | 37/57 X |
| 3,971,593 | 7/1976 | Porte et al. | 37/DIG. 8 |

*Primary Examiner*—Clifford D. Crowder

*Attorney, Agent, or Firm*—Barry G. Magidoff

[57] ABSTRACT

A steerable ocean floor dredge vehicle is provided which is of the towed variety, or partially self-propelled. The vehicle is towed from a surface ship via a rigid length of pipe or tubing, connnected to the dredge vehicle via a pivoting joint permitting pivotal movement about two transverse axes and preferably about a third axis, and a telescoping joint for providing movement along the direction of the axis of the towing line. Two flexible cables are connected to the towing pipe between the telescopic joint and the surface, extending about rollers on the dredge vehicle and being wrapped about a winch powered by a remotely controllable, reversible servo motor. In operation, turning the winch in one direction causes the dredge vehicle to be skewed in a first angular direction relative to the towing pipe, reversing the winch via the servo motor causes the dredge vehicle to be skewed about in an opposite angular direction relative to the towing pipe, thereby permitting at least a limited movement of the dredge vehicle along the ocean floor in directions transverse to the towing pipe.

5 Claims, 5 Drawing Figures

STEERABLE OCEAN FLOOR DREDGE VEHICLE

This invention provides a remotely steerable dredge head vehicle, and the like, which is moved by towing means connected to a surface vessel, along the bottom of the sea.

With the coming shortage of land-based high grade metal ores, miners are turning to new sources of such metals, including especially the bottom of the sea. It has been known for almost a century now that small, generally fist-sized particles of relatively high grade manganese ore, containing in addition valuable quantities of nickel, copper, cobalt and other metals, can be readily obtained by simply dredging the bottom of the ocean. However, the major problems of reaching the depths at which such nodule ores are found in sufficient concentration to be economic, and the problems of refining these ores, have prevented, up to now, the commercial exploitation of this resource.

The art has developed a variety of means for removing these ores from the floor of the oceans and bringing them to the surface, from which they can be refined into the desired valuable metals. Generally, these ores cannot be obtained in commercial quantities at ocean floor depths much above 12,000 feet. It is anticipated that most future mining of the seas will take place at depths of between 12,000 and 20,000 feet beneath the surface of the ocean. Thus, the difficulties of obtaining these ores have been a major problem in preventing their commercial exploitation. Most of the anticipated means for reaching the ocean floor include a device, such as a dredge head, intended to move along the floor of the ocean, towed by a surface vessel. Such devices can move along the ocean floor on skids, or runners, or can move on wheels or lug treads. Such devices include self-propelled devices, wholly passive devices whose motive force is conveyed from the surface of the ocean via a cable or a rigid tubular member, such as a pipe. The rigid pipe can also serve as a means for transporting the collected ores from the dredge head up to the surface, as by an airlift system.

In the towed type of dredge vehicle, regardless of the supporting means between the vehicle and the ocean floor, the main steering means is provided by the connection between the surface vessel and the dredge, which provides the towing force to the dredge. The problems of steering the dredge over the ocean floor is compounded by the extreme length of such a tow line, in that the avoidance of relatively small obstacles on the ocean floor can require a major change in direction of the towing surface vehicle. Those dredge vehicles which are primarily self-propelled, i.e., such as the wheeled vehicle disclosed by U.S. Pat. No. 3,504,943, have articulated members, or means for changing the relative speed of rotation of the wheels or treads on either side of the dredge vehicle, to provide the desired steering. However, the problem remains that the towed vehicles are the simplest vehicles to operate and, therefore, the cheapest to construct and maintain, with the least complications and thus smallest chance of becoming disabled. However, steering these towed dredge vehicles has remained a substantial problem preventing, or severely limiting, the commercial use of such towed vehicles for exploiting the ores on the ocean bottom.

In accordance with the present invention, there is now provided a towed dredge vehicle, which can be remotely steered from the surface towing vessel, without requiring any change in direction of the surface vessel, in order to avoid relatively small obstacles on the ocean floor. The steerable dredge vehicle includes relatively rigid lower towing connector means, secured to the dredge vehicle; an upper towing connector means pivotally connected to the lower towing connector means; and a pivotable joint secured to the upper and lower towing connector means, the joint permitting relative pivotal movement between the upper and lower connecting means about at least two axes transverse to each other and to the longitudinal axis of the towing connector means; towing means connected telescopically to the upper towing connector means permitting relative movement between the towing means and the upper connector means along a direction parallel to the longitudinal axis of the towing means; linear steering linkage means between the relatively rigid towing means and the dredge vehicle; means for moving the linear steering linkage means relative to the dredge vehicle so as to cause pivotal motion of the dredge vehicle relative to the towing means and upper towing connector means in a first angular direction by movement of the linear steering linkage means in a first linear direction, and causing an opposite pivotal movement between the towing means and the dredge vehicle in a second angular direction by movement of the linear steering linkage means in a second opposing linear direction.

The invention defined herein is exemplified by the preferred embodiment described hereinbelow and depicted in the accompanying drawings. This preferred embodiment is presented herein to provide a more clear understanding of the invention and its advantages.

Figure 1:
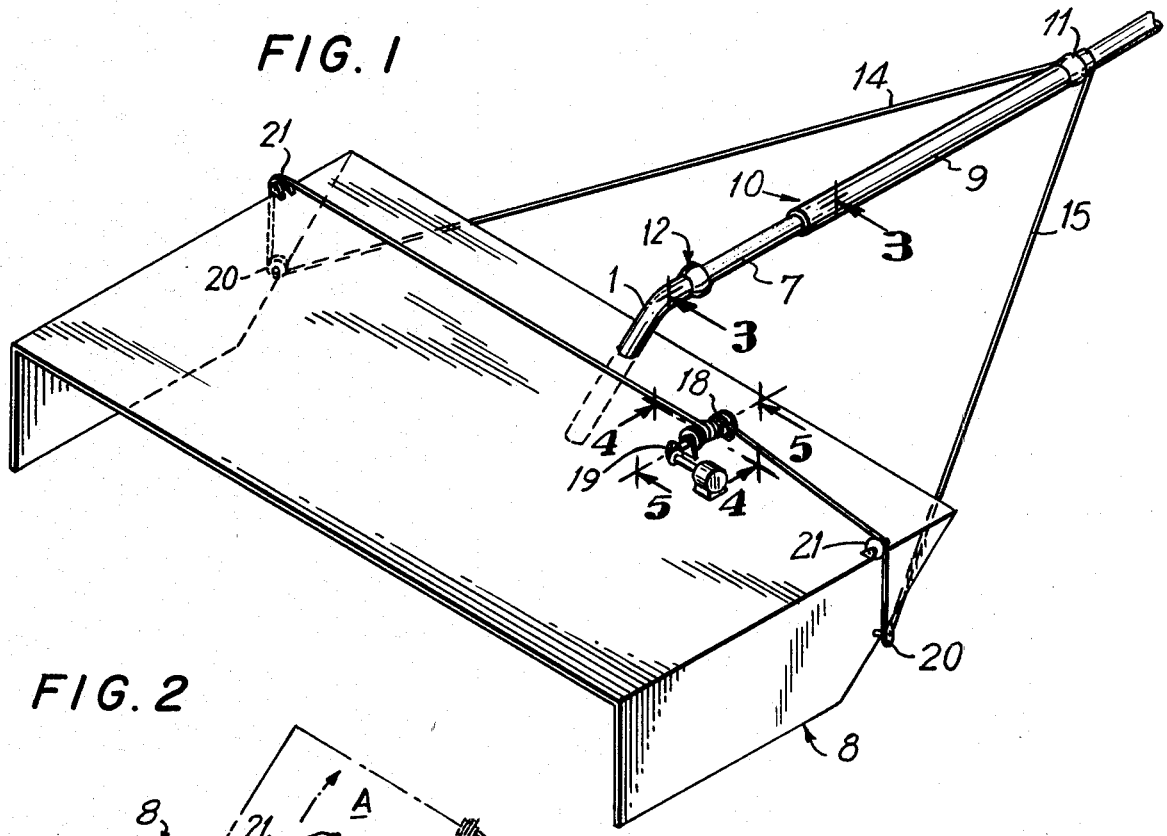
FIG. 1 is an overall isometric sketch depicting the concept of the present invention.

In the drawings, a dredge vehicle, generally indicated by the numeral 8, is of the sled or skid runner type. The dredge vehicle 8 is, in this embodiment, rigidly connected to a lower connecting tow member 1, which is a relatively rigid length of bent pipe rigidly secured to the dredge vehicle 8, substantially at the forward edge of its upper portion. The lower connector pipe 1 is rigidly secured at its upper end to a portion of a universal joint, generally designated by the numeral 12. The lower connector pipe 1 is rigidly secured, in this case welded to form a single unit, to the concave hollowed-out portion 13 of the universal joint 12. A convex, generally ball-shaped member 24, is rotatably held within the concave portion 13 and rigidly secured, as by welding to form a single unit, to the upper tow pipe connector piece 7. The upper connector member 7 is in turn telescopically connected to the lower tow pipe section 9 via a telescoping joint generally designated by the numeral 10. The upper tow line connector 7 reciprocally fits within the lower portion of the tow line 9. A knuckle joint 11 is rigidly connected to the tow pipe 9 and has pinned thereto the ends of the steering cable 14.

The flexible steering cables 14, 15 each extend from the knuckle 11, transverse to the tow pipe 9, to a lower roller 20 secured to each side of the dredge vehicle 8, then to a pair of upper rollers 21, secured to the upper edge of the dredge vehicle 8, and then to the steering winch 18. The steering cables 14, 15 are wrapped about the winch 18. The cables 14, 15 can be a single length of cable wrapped about the winch 18 in a way to prevent slippage, or two lengths of cable, the ends of each being pinned to the barrel of the winch 18. The winch 18 is operated by the electrically operated hydraulic servo motor 16 which is connected to the winch 18 via the winch drive shaft 19.

Figure 4:
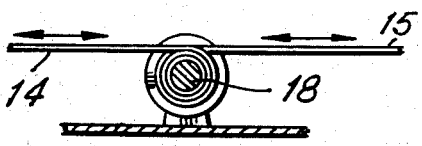
FIG. 4 is a partial cross-section taken along lines 4—4 of FIG. 1.
Figure 5:
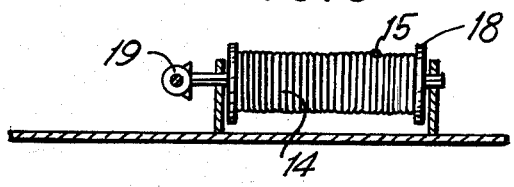
FIG. 5 is a view taken along lines 5—5 of FIG. 1.

In operation, the far upper end of the dredge tow line 9 is connected to a surface vessel which tows the dredge vehicle 8 along the ocean surface, which can be 12,000 to 20,000 feet below the surface of the ocean. The dredge vehicle can be steered by remotely activating, as by electrical impulse, the hydraulic servo motor 16 so as, in the first instance, to cause rotation of the winch 18 in a clockwise direction, referring to the view of FIG. 4, thus causing the cable end 14 to be pulled towards the right in FIG. 4, and the cable end 15 to be moved towards the right. This causes the dredge vehicle 8 to pivot about the universal joint 12 so as to assume the relative position indicated by the phantom lines "A" in FIG. 2, thus causing the dredge vehicle 8 to move towards the right, in the view of FIG. 1. This can be thus used to steer about an obstacle; when the desired degree of movement has been obtained, the winch motor 16 can be remotely activated in a reverse direction so as to cause the cable end 15 to be pulled towards the left, as shown in FIG. 4, thus allowing the cable end 14 to move also towards the left, bringing the dredge vehicle 8 back towards the position indicated by the solid lines in FIG. 2. By continuing the movement of the winch in the counterclockwise direction, again referring to FIG. 4, the dredge vehicle 8 can be moved to the attitude, or position, indicated by the phantom lines "B" in FIG. 2, thus permitting the vehicle to be steered towards the left, referring to FIG. 1.

Figure 2:
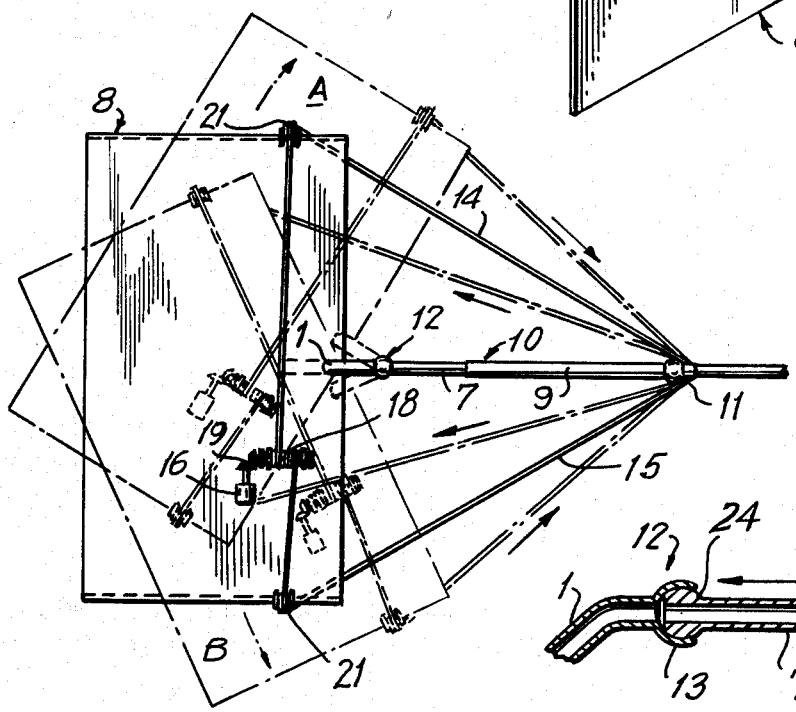
FIG. 2 is a plan view showing the various positions of the dredge vehicle by phantom lines.
Figure 3:
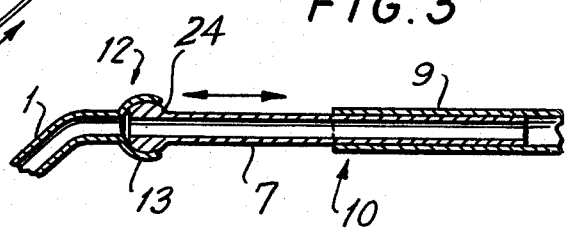
FIG. 3 is a partial cross-section taken along lines 3—3 of FIG. 1.

In the preferred embodiment shown in FIG. 1, the towing pipe line 1, 7, 9, etc., also serves as means for carrying the dredged ore from the dredge vehicle up to the surface vessel, for example, by means of an airlift system such as is described in U.S. Pat. No. 3,522,670. The dredge vehicle can be of any type, including the suction type of dredge, for example, as disclosed in U.S. Pat. No. 3,522,670, a mechanical type dredge vehicle, or other system. As explained above, although the sled or runner type of vehicle is most easily adaptable to the present steering system, any other type of system including a wheeled vehicle or a lug tread vehicle can be utilized.

The universal joint 12 can be replaced by any other type of system, including a double pin system providing for pivotal motion about two transverse, most preferably perpendicular, axes. Similarly, the telescopic joint 10 can be substituted by, for example, a bellows type of system or other elastic means which will permit the relative longitudinal movement between the dredge vehicle 8 and the main tow line during the pivotal movement supplied by the steering linkages 14, 15.

The steering cables 14, 15, and the rotating winch means 18, can be replaced by other equivalent members which can provide the relative pivotal motion shown in the drawings and described above. For example, relatively rigid arms, containing elbow linkages, can be utilized, but would require a more complicated arrangement. The advantage of the steering cables depicted in the drawings, is their simplicity, which is extremely important in the relatively hostile environment of the ocean floor, on which even minor routine maintenance requires a great deal of effort and expense.

The steering cables 14, 15, can be made of any preferably relatively flexible material, although stainless steel spun cable is preferred, preferably including a smooth plastic cover. The servo motor 16, although preferably of the hydraulic type, can be operated directly by electric current or other means. The servo motor can directly drive the winch 18, or indirectly through a geared transmission. A clutch is preferably included so as to prevent breakdown of the motor in the event of a snag in the cable or a blockage preventing the rotation of the winch 18.

Alternative arrangements for the steering system can be provided where the steering cable, for example, is pinned at one end to the dredge vehicle and the winch is secured to the tow line pipe. Furthermore, the embodiment of the drawings can be modified by providing a third pair of rollers secured to the pipe line, and the end of the steering cable remote from the winch can pass around the pipe line roller and return to the dredge vehicle to which it can be pinned.

The embodiments defined above and depicted in the drawings are merely those which are preferred in accordance with the present knowledge of the inventors, but are not intended to define the full scope of the present invention. The scope of the invention is defined solely by the claims set forth below.

The patentable embodiments of this invention which are claimed are:

1. A dredging system designed and adapted to be towed along the ocean floor via a surface vessel connected thereto by a tow line, the dredge system comprising:

(a) a dredge vehicle;

(b) lower tow connector means secured to the dredge vehicle;

(c) means for pivotally and telescopically securing the lower tow connector to the tow line;

(d) first and second linear steering linkages extending from the tow line to opposing sides of the dredge vehicle; and (e) means for alternately activating the first and second linear steering linkages in opposite directions, whereby the dredge vehicle can be pivoted relative to the tow line by pulling on the first steering linkage, and can be pivoted in an opposite direction relative to the tow line by pulling on the second steering linkage.

2. The steerable dredge system of claim 1 wherein the linear steering linkages comprise relatively flexible cable pinned at a first end thereof to the towing line and connected at their opposite end to opposing sides of the dredge vehicle and then to rotating means for pulling the cables in opposite directions.

3. The steerable dredge system of claim 2 wherein the first and second steering cables are wrapped in opposing directions about a winch barrel, and comprising in addition remotely controllable motive means capable of rotating the winch in two opposing directions.

4. The steerable dredge system of claim 3 wherein the lower tow connector means is connected to the tow line via a ball joint and a telescopic joint.

5. A remotely steerable towed dredge system, comprising a dredge vehicle having runners designed and adapted to support the vehicle on the ocean floor, a lower substantially rigid tow connector secured to the dredge vehicle;

an upper tow connector rotatably secured so as to be capable of rotational and pivotal motion relative to the lower tow connector about three mutually perpendicular axes;

a substantially rigid tow line portion connected telescopically to the upper tow connector, whereby the upper tow connector is capable of reciprocal longitudinal movement relative to the rigid tow line portion;

first and second steering cable means secured to the rigid tow line portion;

a winch means secured to the dredge vehicle having a barrel about which the first and second steering cable means are wrapped in opposing directions;

roller means secured to the dredge vehicle on each of two sides of the winch means for supporting each cable means at a first location, respectively, on the dredge vehicle; and remotely activatable motor means for driving the winch means in two relatively opposite rotational directions; whereby causing the winch to turn in a first direction causes the dredge vehicle to pivot relative to the rigid tow line portion in a first direction, and causing the winch to rotate in a second opposing direction causes the dredge vehicle to pivot in a second opposing direction relative to the tow line.

* * * * *